US011419433B2

(12) United States Patent
Guo et al.

(10) Patent No.: US 11,419,433 B2
(45) Date of Patent: Aug. 23, 2022

(54) CHILD CARE APPARATUS

(71) Applicant: Wonderland Switzerland AG, Steinhausen (CH)

(72) Inventors: Zheng-Wen Guo, Guangdong (CN); Junjie Hu, Guangdong (CN)

(73) Assignee: Wonderland Switzerland AG, Steinhausen (CH)

( * ) Notice: Subject to any disclaimer, the term of this patent is extended or adjusted under 35 U.S.C. 154(b) by 0 days.

(21) Appl. No.: 17/022,397

(22) Filed: Sep. 16, 2020

(65) Prior Publication Data

US 2021/0076842 A1 Mar. 18, 2021

(30) Foreign Application Priority Data

Sep. 18, 2019 (CN) ..... 201910882253.9

(51) Int. Cl.
*A47D 9/04* (2006.01)

(52) U.S. Cl.
CPC ..... *A47D 9/04* (2013.01)

(58) Field of Classification Search
CPC . A47D 9/04; A47D 9/00; A47D 13/00; A47D 13/10; A47D 9/02
See application file for complete search history.

(56) References Cited

U.S. PATENT DOCUMENTS

2018/0206651 A1* 7/2018 Gallina ..... A47D 9/04

FOREIGN PATENT DOCUMENTS

| | | |
|---|---|---|
| CN | 201085351 | 7/2008 |
| CN | 201167750 | 12/2008 |
| CN | 104382420 | 3/2015 |
| GB | 137633 | 1/1920 |

OTHER PUBLICATIONS

Extended European Search Report (EESR) of the corresponding European Patent Application No. 20196934.2 dated Oct. 27, 2020.

* cited by examiner

*Primary Examiner* — Peter M. Cuomo
*Assistant Examiner* — Adam C Ortiz
(74) *Attorney, Agent, or Firm* — NZ Carr Law Office PLLC

(57) ABSTRACT

A child care apparatus includes a standing frame including a mounting portion, and a child support frame held on the standing frame via at least one hanging bar that has an end portion pivotally connected with the mounting portion, the hanging bar being rotatable for swinging the child support frame, wherein the end portion of the hanging bar is pivotally connected with the mounting portion at a position that is adjustable on the mounting portion.

13 Claims, 15 Drawing Sheets

CHILD CARE APPARATUS

CROSS-REFERENCE TO RELATED APPLICATION(S)

This application claims priority to China patent application no. 201910882253.9 filed on Sep. 18, 2019.

BACKGROUND

1. Field of the Invention

The present invention relates to a child care apparatus having a swingable child support.

2. Description of the Related Art

Baby cribs can provide a comfortable and safe environment for sleeping a young child. For helping the child to fall asleep, the baby crib may include a child support that can be swung in use. Unfortunately, some existing baby cribs may have a frame structure that does not allow convenient use as a bedside crib, because the child support is held at a distance not easily accessible for a caregiver resting on an adult bed.

Therefore, there is a need for a child care apparatus that can be convenient to use, and address at least the foregoing issues.

SUMMARY

The present application describes a child care apparatus having hanging bars that can be pivotally supported at different positions, whereby a child support frame held with the hanging bars can be used in different configurations and can have different swinging modes.

According to one embodiment, the child care apparatus includes a standing frame including a mounting portion, and a child support frame held on the standing frame via at least one hanging bar that has an end portion pivotally connected with the mounting portion, the hanging bar being rotatable for swinging the child support frame, wherein the end portion of the hanging bar is pivotally connected with the mounting portion at a position that is adjustable on the mounting portion.

DETAILED DESCRIPTION OF THE EMBODIMENTS

The present application provides a child care apparatus that includes a standing frame, and a child support frame connected with the standing frame via hanging bars. The standing frame has a mounting portion that can pivotally support hanging bars at adjustable positions, whereby a child support frame held with the hanging bars can be used in different configurations and can have different swinging modes. Embodiments of the child care apparatus described herein include baby cribs. However, it will be appreciated that child care apparatuses that may incorporate the structures and features described herein can include, without limitation, child swings, child rockers, child motion apparatuses, and the like.

Figure 1:
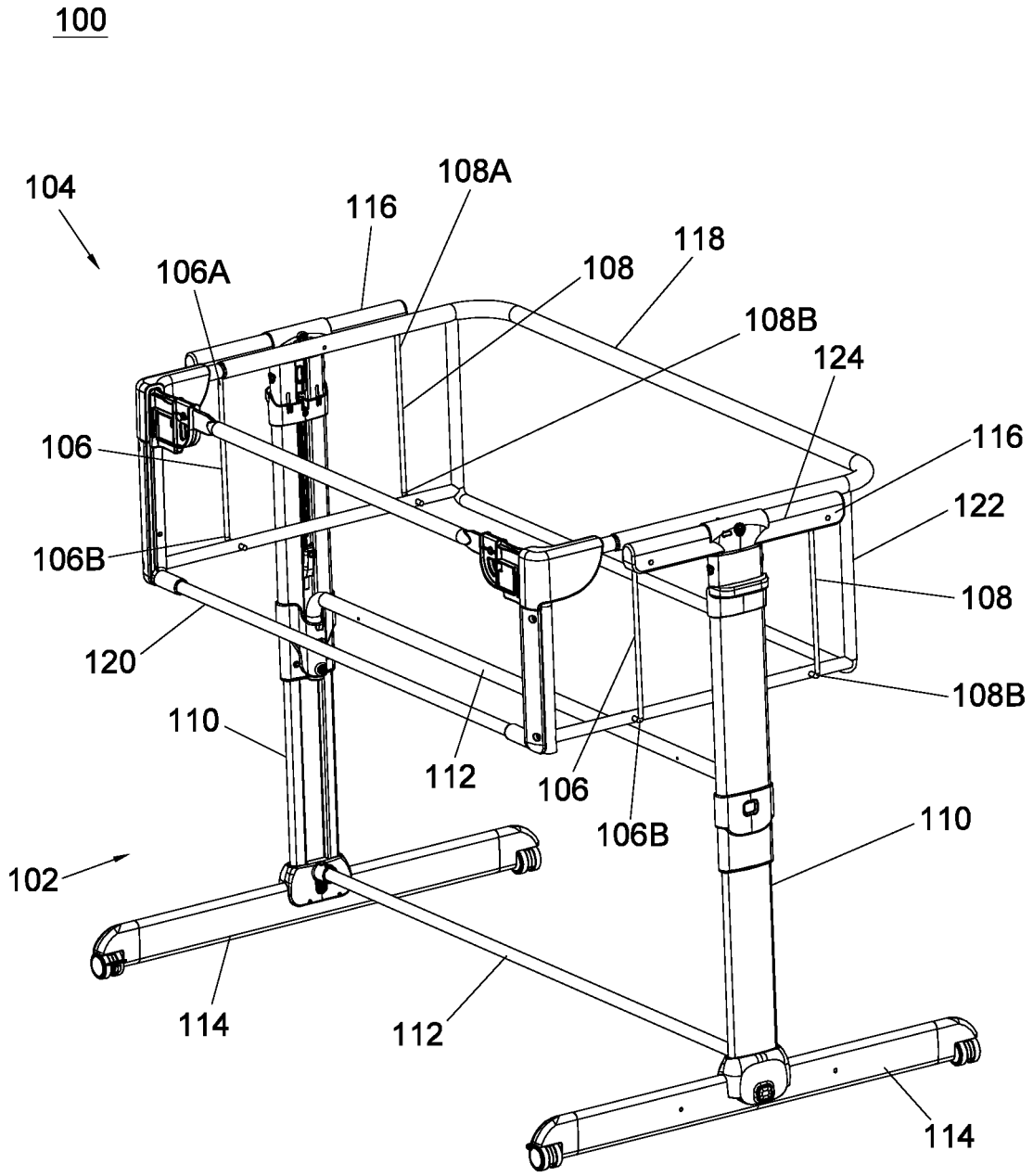
FIG. 1 is a perspective view illustrating an embodiment of a child care apparatus.
Figure 2:
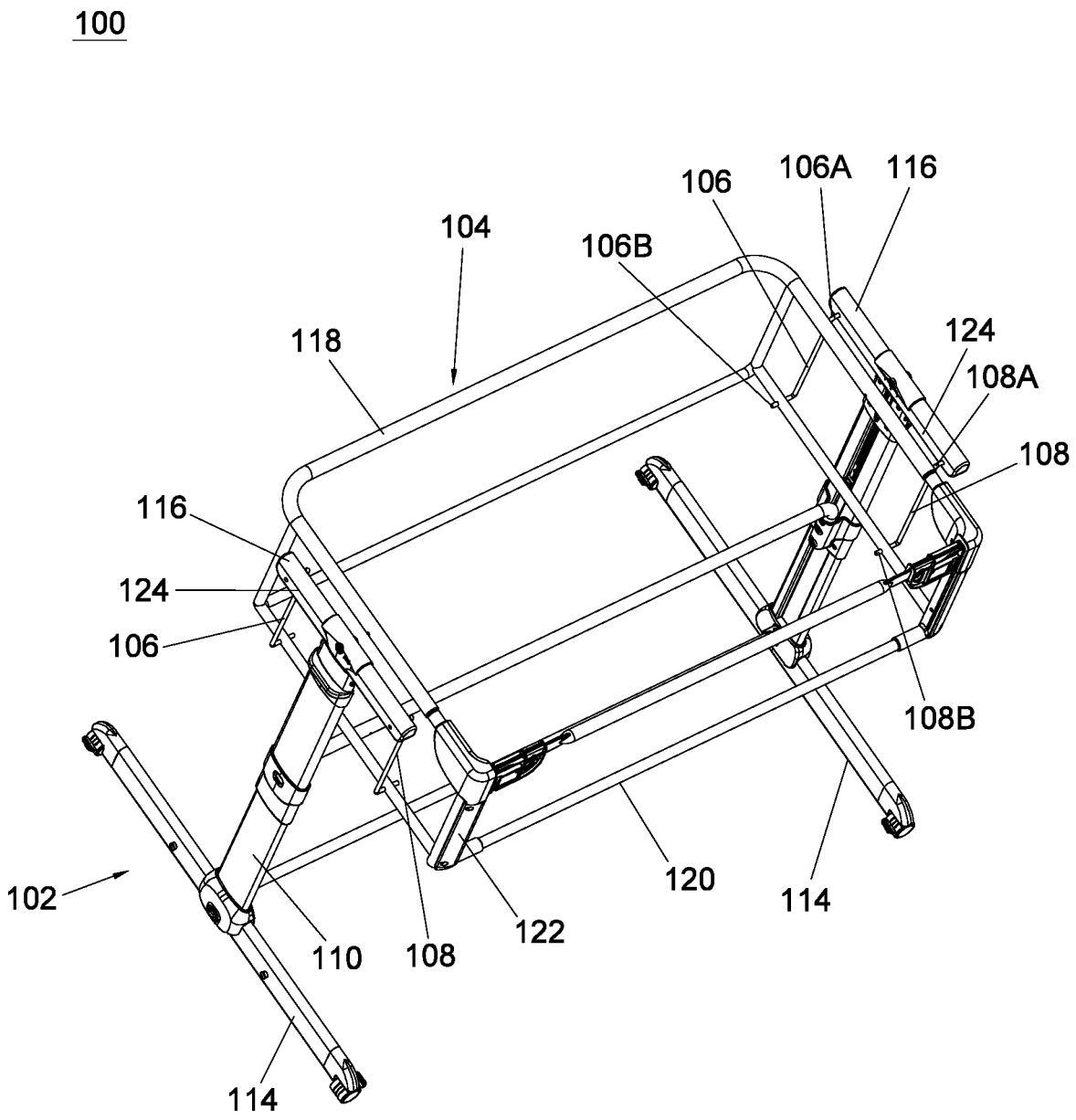
FIG. 2 is another perspective view of the child care apparatus.

FIGS. 1 and 2 are two perspective views illustrating an embodiment of a child care apparatus 100, which is exemplarily a baby crib. Referring to FIGS. 1 and 2, the child care apparatus 100 can include a standing frame 102, and a child support frame 104 held on the standing frame 102 via a plurality of hanging bars 106 and 108. According to an example of construction, the standing frame 102 can include two support legs 110 that are spaced apart from each other and can extend generally along an upright direction, and one or more transversal bar 112 connected with the two support legs 110 below the child support frame 104. Each support leg 110 can have a lower end connected with a foot portion 114, and an upper end connected with a mounting portion 116. The foot portions 114 can provide stable support for the child care apparatus 100 on a floor surface. The two mounting portions 116 can be respectively connected fixedly with the two support legs 110. Moreover, each mounting portion 116 can be pivotally connected with two hanging bars 106 and 108, which can extend downward from the mounting portion 116 and can be connected with the child support frame 104 below the mounting portion 116.

Referring to FIGS. 1 and 2, the child support frame 104 provides a rigid support to which a fabric and/or softgoods can be attached to define an interior space suitable to receive a young child. According to an example of construction, the child support frame 104 can include an upper frame portion 118, a lower frame portion 120, and a plurality of upright posts 122 connected with the upper and lower frame portions 118 and 120. The upper frame portion 118, the lower frame portion 120 and the upright posts 122 can include a plurality of rigid tubes and/or bars, which can be assembled to define an enclosure frame.

According to an example of construction, the child support frame 104 can be placed between the two support legs 110 so that two opposite sides of the child support frame 104 are respectively adjacent to the two support legs 110, and two pairs of hanging bars 106 and 108 can be provided for linking the two opposite sides of the child support frame 104 to the two mounting portions 116 of the support legs 110. More specifically, two hanging bars 106 and 108 can respectively couple each of the two opposite sides of the child support frame 104 to one corresponding mounting portion 116. For example, the hanging bar 106 can have two opposite end portions 106A and 106B, the hanging bar 108 can have two opposite end portions 108A and 108B, the end portions 106A and 108A can be respectively connected pivotally with the mounting portion 116, and the end portions 106B and 108B can be respectively connected pivotally with the lower frame portion 120 of the child support frame 104. According to an example of construction, the mounting portion 116 can include a housing 124 that is fixedly connected with the support leg 110 at a top thereof, the end portion 106A of the hanging bar 106 and the end portion 108A of the hanging bar 108 can be respectively supported pivotally by the housing 124, and the end portion 106B of the hanging bar 106 and the end portion 108B of the hanging bar 108 can be respectively connected pivotally with the lower frame portion 120 of the child support frame 104. Accordingly, the hanging bars 106 and 108 can hold the child support frame 104 at an elevated position above a floor surface, and are rotatable relative to the standing frame 102 for swinging the child support frame 104 between the two support legs 110. According to an example of construction, the child support frame 104 may be held at an elevated position above a floor surface and protrude higher than the mounting portions 116, which may facilitate access to the child support frame 104 and provide improved visibility. Owing to the pivot connection of the hanging bars 106 and 108 with the child support frame 104, the child support frame 104 may remain in a same horizontal orientation during the swing motion.

Figure 3:
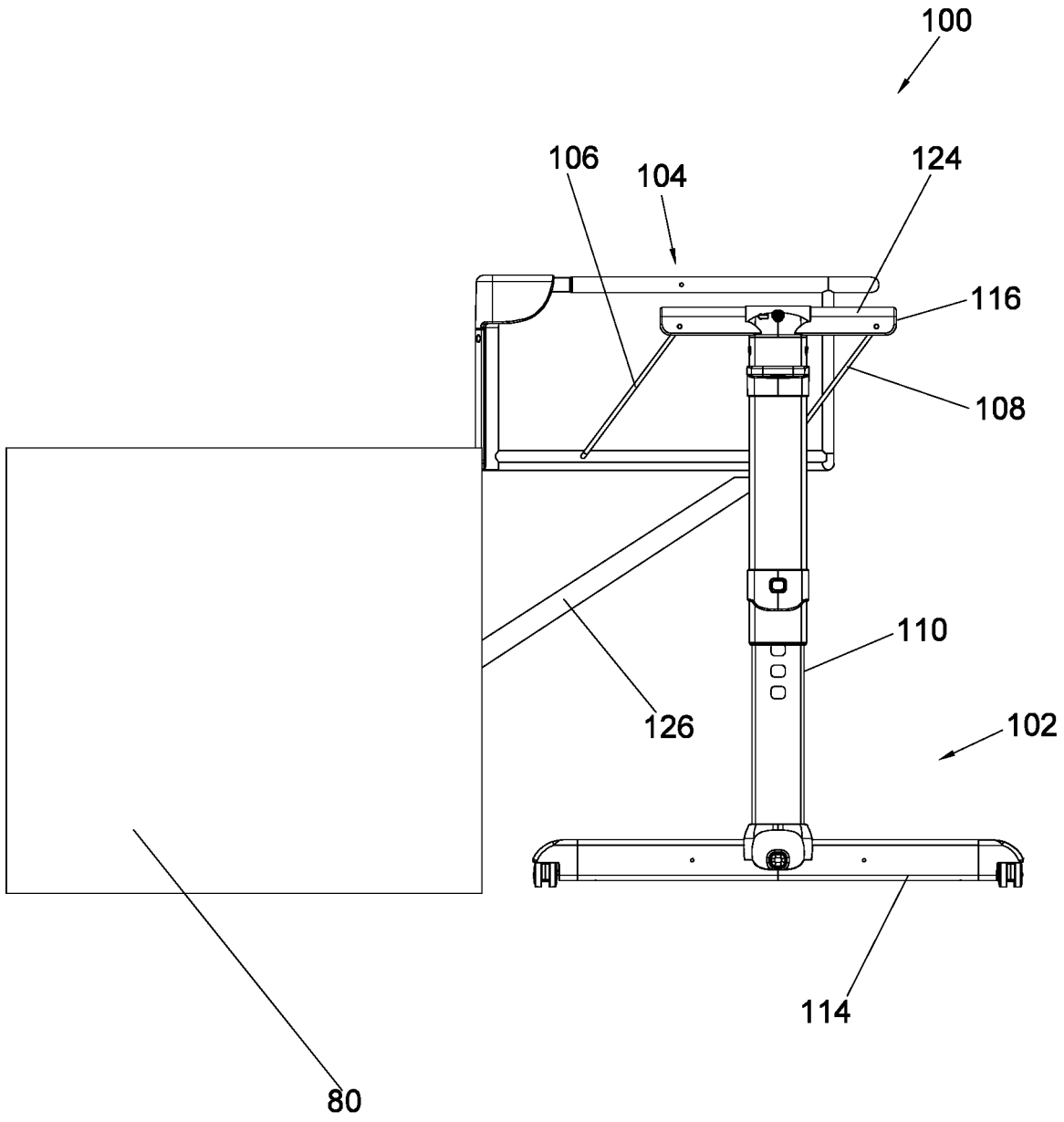
FIG. 3 is a side view illustrating exemplary use of the child care apparatus as a bedside crib.

In conjunction with FIGS. 1 and 2, FIG. 3 is a side view illustrating exemplary use of the child care apparatus 100 as a bedside crib. Referring to FIG. 3, the child care apparatus 100 can be placed next to a side of an adult bed 80 for use as a bedside crib. A linking part 126 may be respectively attached to the adult bed 80 and the child support frame 104 so as to restrict the position of the child support frame 104 relative to the adult bed 80 and prevent its swinging. Examples of the linking part 124 can include, without limitation, a strap, a belt, a cable, a cord, a rope, a tether, and the like.

Figure 4:
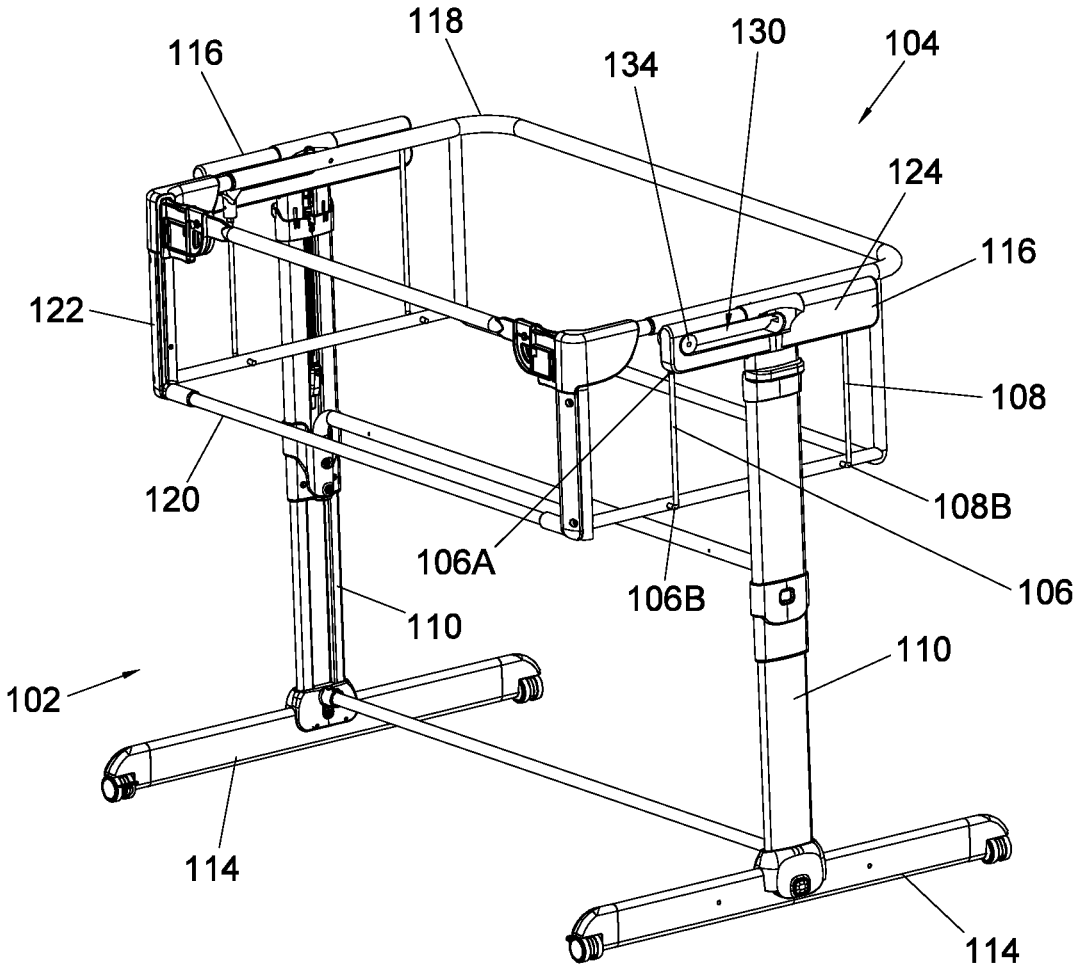
FIG. 4 is a perspective view illustrating the child care apparatus including an example of construction for coupling two hanging bars to a mounting portion at a top of a support leg.
Figure 5:
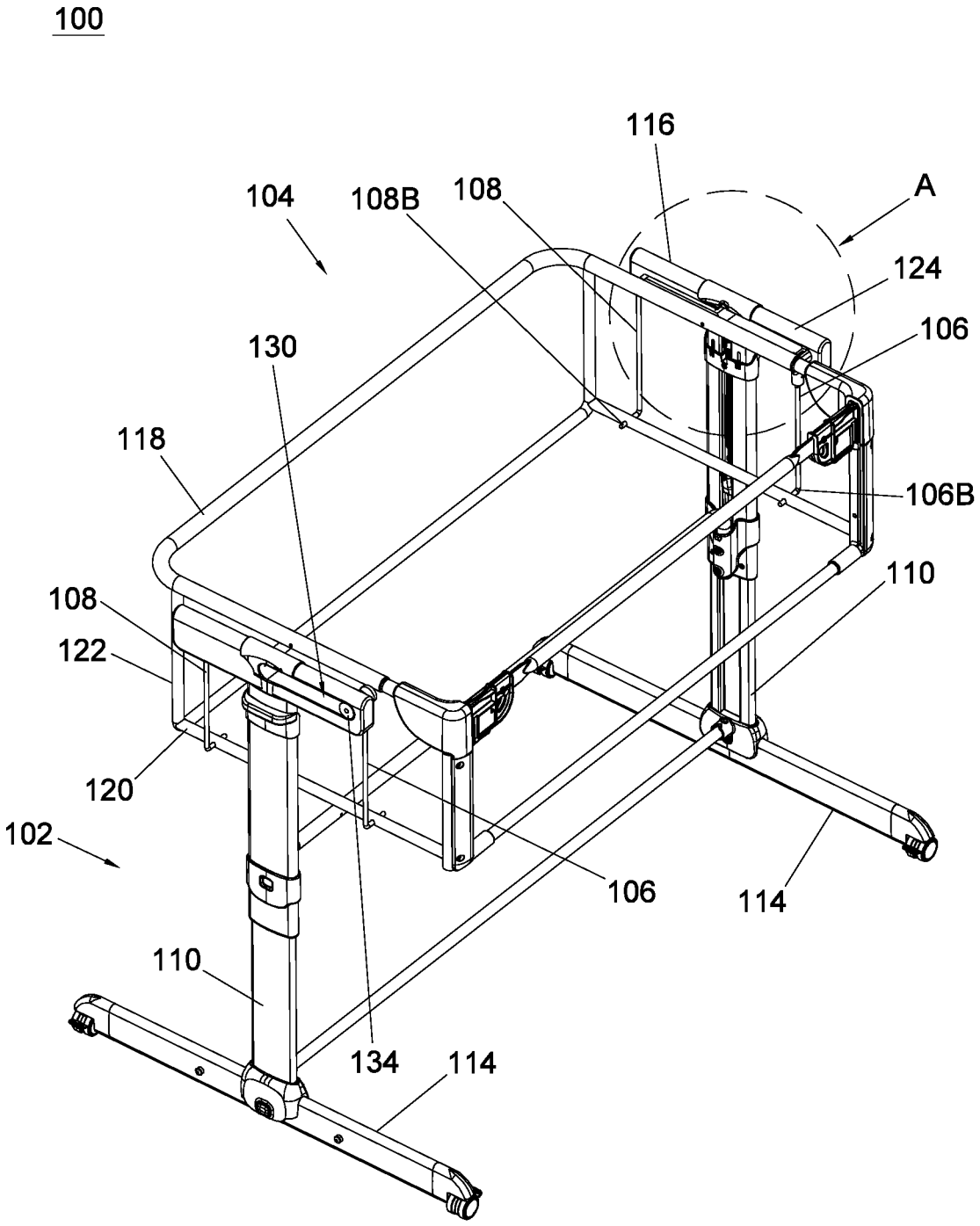
FIG. 5 is another perspective view of the child care apparatus shown in FIG. 4.
Figure 6:
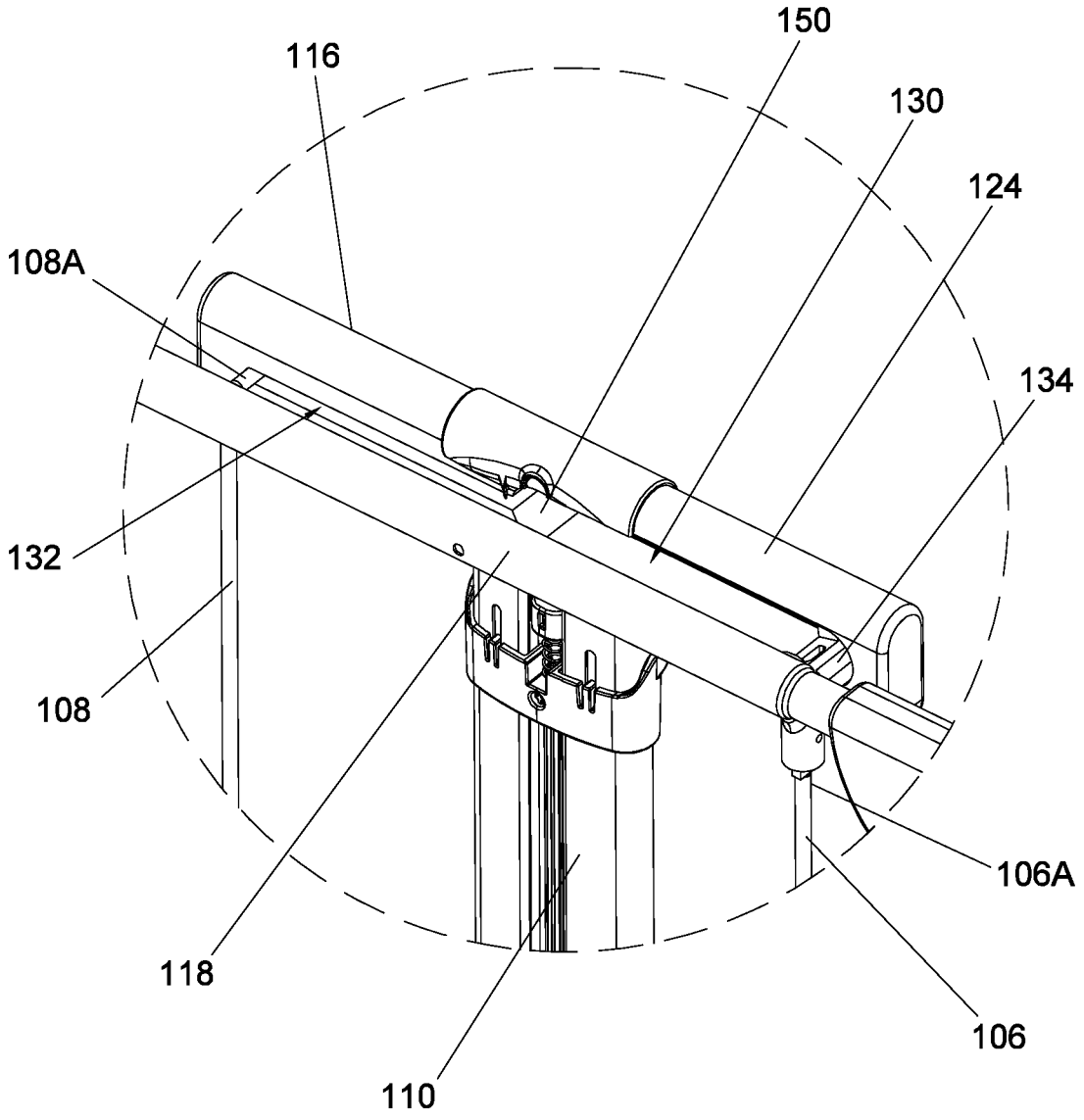
FIG. 6 is an enlarged view of portion A shown in FIG. 5.
Figure 7:
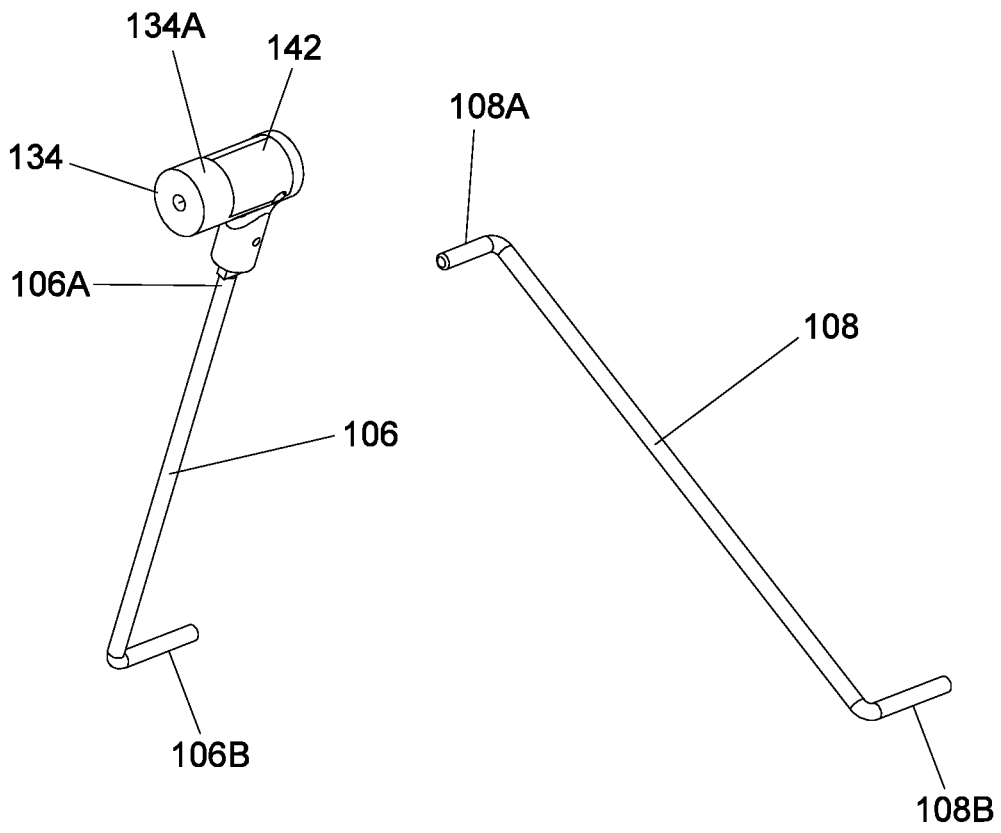
FIG. 7 is a perspective view illustrating some construction details of two hanging bars provided in the child care apparatus shown in FIG. 4.
Figure 8:
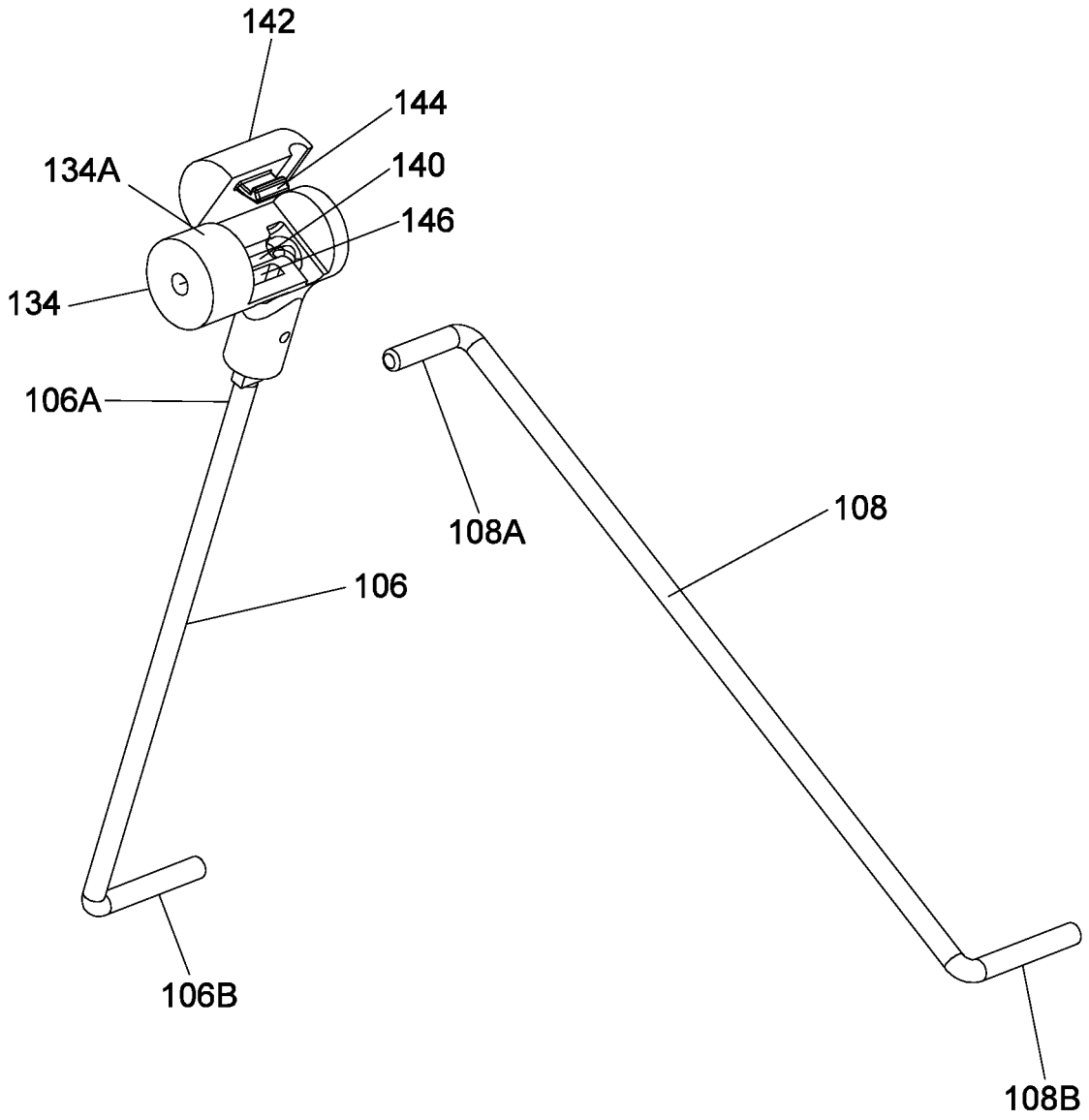
FIG. 8 is a perspective view illustrating further construction details of the hanging bars shown in FIG. 7.
Figure 9:
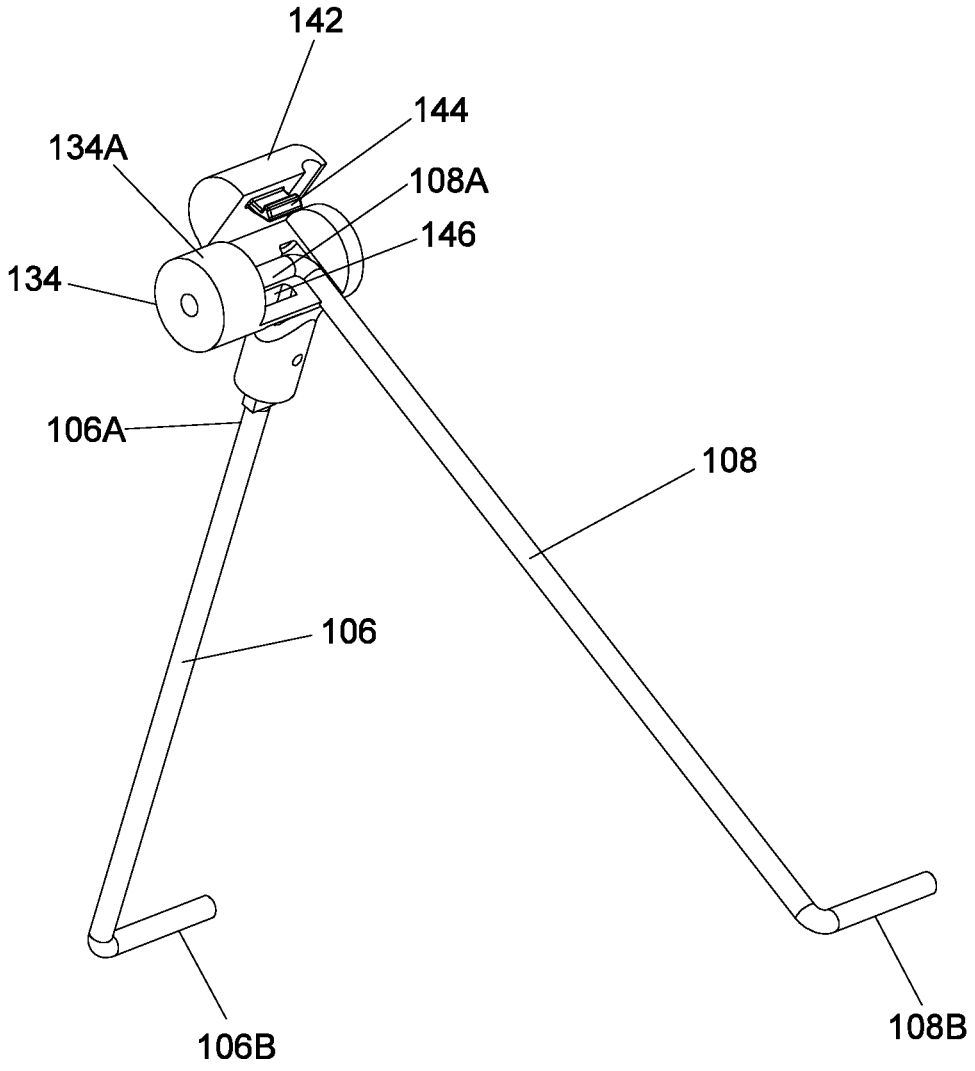
FIGS. 9 and 10 are two perspective views illustrating how the two hanging bars shown in FIG. 7 can be fixedly attached to each other.
Figure 10:
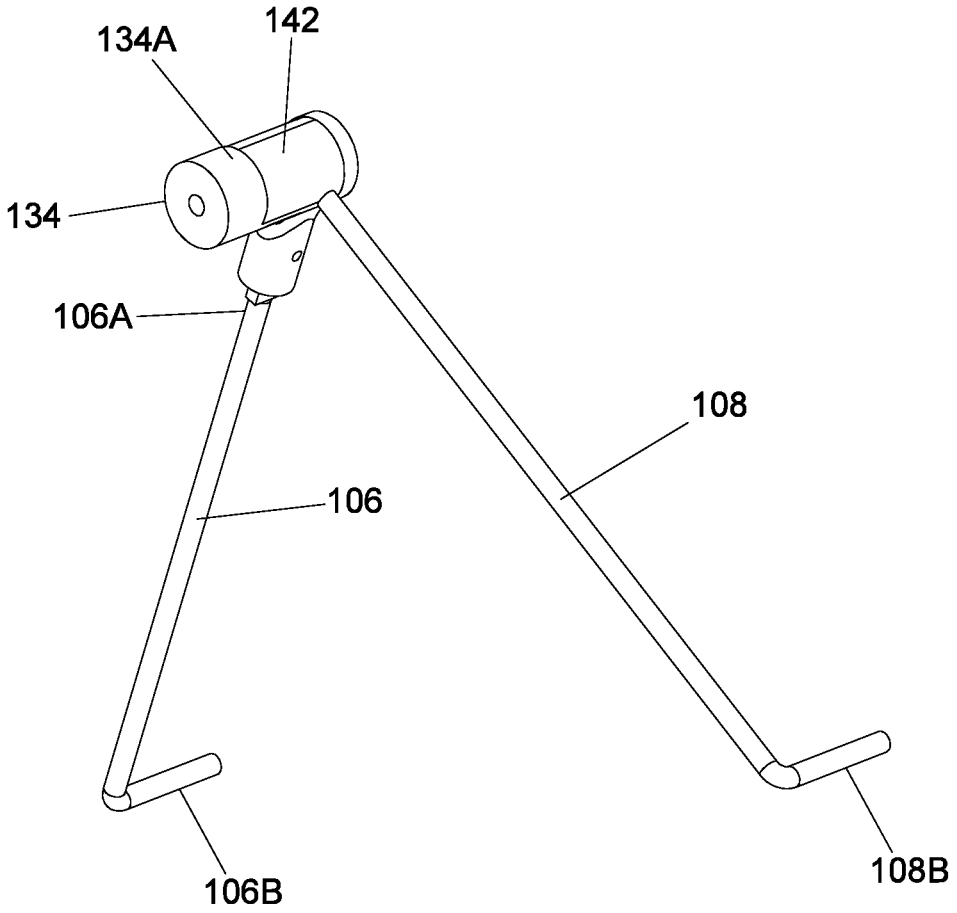

In conjunction with FIGS. 1 and 2, FIGS. 4-6 are schematic views illustrating an example of construction for coupling the two hanging bars 106 and 108 to the mounting portion 116 at the top of each support leg 110. Referring to FIGS. 4-6, the mounting portion 116 can be configured to allow the end portions 106A and 108A of the hanging bars 106 and 108 to be displaced relative to the mounting portion 116 so that the end portion 106A of the hanging bar 106 is pivotally connected with the mounting portion 116 at a position that is adjustable on the mounting portion 116, and the end portion 108A of the hanging bar 108 is likewise pivotally connected with the mounting portion 116 at a position that is adjustable on the mounting portion 116.

According to an example of construction, the housing 124 of the mounting portion 116 can include two receiving slots 130 and 132, the end portion 106A of the hanging bar 106 can be pivotally supported in the receiving slot 130 and adjustable to different positions along the receiving slot 130, and the end portion 108A of the hanging bar 108 can be pivotally supported in the receiving slot 132 and adjustable to different positions along the receiving slot 132. According to an example of construction, each of the end portion 106A of the hanging bar 106 and the end portion 108A of the hanging bar 108 can be connected pivotally and slidably with the mounting portion 116. For example, the end portion 106A of the hanging bar 106 can be pivotally supported in and slidable along the receiving slot 130, and the end portion 108A of the hanging bar 108 can be pivotally supported in and slidable along the receiving slot 132.

The end portions 106A and 108A of the hanging bars 106 and 108 may have any suitable structures adapted to form a movable connection with the receiving slots 130 and 132 of the mounting portion 116. According to an example of construction, the end portion 106A of the hanging bar 106 can have a coupling part 134 fixedly attached thereto that is at least partially disposed in the receiving slot 130, the coupling part 134 being adapted to rotate in the receiving slot 130 and slide along the receiving slot 130. According to an example of construction, the end portion 108A of the hanging bar 108 can have a bend portion that is at least partially disposed in the receiving slot 132, the bend portion being rotatable in the receiving slot 132 and slidable along the receiving slot 132. Examples of suitable shapes for the aforementioned connection with the receiving slots 130 and 132 may include, without limitation, cylindrical shapes, circular shapes, or spherical shapes.

With the aforementioned construction, the hanging bar 106 can rotate relative to the mounting portion 116, and the end portion 106A of the hanging bar 106 can be placed at different positions along the receiving slot 130, whereby the position where the hanging bar 106 is pivotally supported on the mounting portion 116 can be modified as desired. Likewise, the hanging bar 108 can rotate relative to the mounting portion 116, and the end portion 108A of the hanging bar 108 can be placed at different positions along the receiving slot 132, whereby the position where the hanging bar 108 is pivotally supported on the mounting portion 116 can be modified as desired.

According to an example of construction, the receiving slot 130 can generally extend along a horizontal axis, and can be formed as an opening of an elongate shape that is respectively exposed on an inner side of the housing 124 facing the child support frame 104 and an outer side of the housing 124 opposite to the inner side. The receiving slot 132 can have an elongate shape generally extending along a horizontal axis, and can be provided on the inner side of the housing 124 facing the child support frame 104. Accordingly, the end portion 106A of the hanging bar 106 and the end portion 108A of the hanging bar 108 can be horizontally adjusted in position on the mounting portion 116.

In conjunction with FIGS. 4-6, FIGS. 7-10 are schematic views illustrating an example of construction for the coupling part 134 provided on the hanging bar 106. Referring to FIGS. 7-10, the coupling part 134 may be configurable to fixedly attach together the end portions 106A and 108A of the hanging bars 106 and 108. According to an example of construction, the coupling part 134 can include a housing 134A having an inner cavity 140 that is fixedly attached to the hanging bar 106, and a cover 142 connected with the housing 134A. The inner cavity 140 is adapted to at least partially receive the end portion 108A of the hanging bar 108 for fixedly attaching the hanging bars 106 and 108 together. The cover 142 can be open for access to the inner cavity 140, and can close over the inner cavity 140. The cover 142 may be locked in the closing state by providing a latch 144 on the cover 142 that can engage with a locking groove 146 provided on the housing 134A. According to an example of construction, the coupling part 134 may be assembled with the mounting portion 116 with the housing 134A and the cover 142 of the coupling part 134 protruding outward on the inner side of the mounting portion 116 facing the child support frame 104. The coupling part 134 described herein is thus operable to attach or detach the end portions 106A and 108A of the hanging bars 106 and 108 as desired.

The ability to modify the positions where the end portions 106A and 108A are pivotally supported on the mounting portion 116 can provide different configurations. For example, a distance between the two positions where the end portion 106A of the hanging bar 106 and the end portion 108A of the hanging bar 108 are respectively supported pivotally by the mounting portion 116 may be modified as desired, which may provide different swinging modes for the child support frame 104. Moreover, the child support frame 104 and the hanging bars 106 and 108 may be displaced horizontally as a whole relative to the standing frame 102, which may provide different horizontal positions of the child support frame 104 relative to the standing frame 102.

Figure 11:
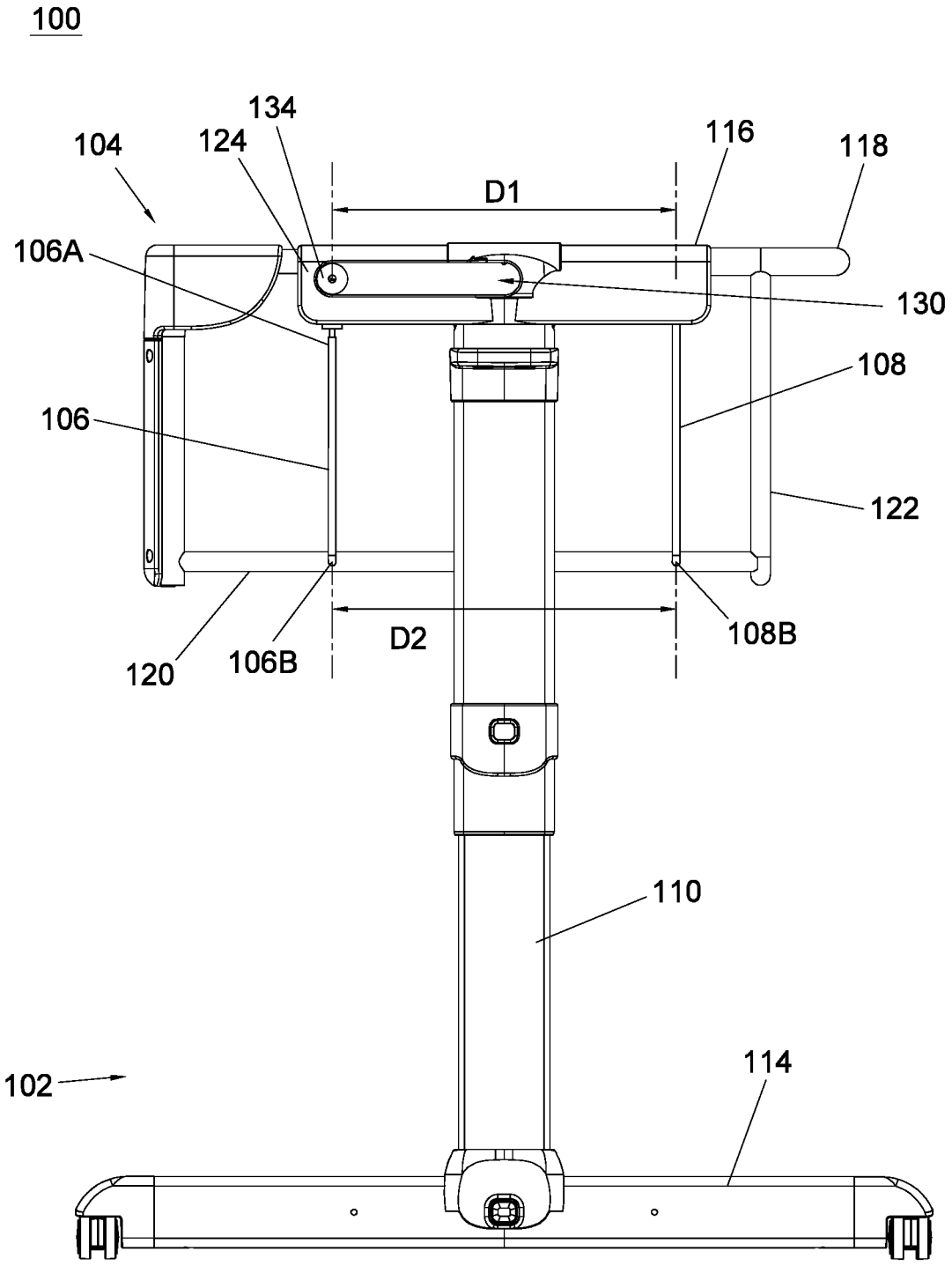
FIG. 11 is a side view illustrating the child care apparatus in a configuration with the two hanging bars on a same side disposed generally parallel to each other.

In conjunction with FIGS. 4-10, FIGS. 11-15 are side views illustrating some examples of configurations for the hanging bars 106 and 108 in the child care apparatus 100. Referring to FIG. 11, the child care apparatus 100 is shown in a configuration where the end portion 106A of the hanging bar 106 and the coupling part 134 thereon are disposed apart from the end portion 108A of the hanging bar 108 on the mounting portion 116, and the hanging bars 106 and 108 are disposed generally parallel to each other. In the configuration shown in FIG. 11, a distance D1 between the two positions where the end portion 106A of the hanging bar 106 and the end portion 108A of the hanging bar 108 are respectively supported pivotally by the mounting portion 116 can be substantially equal to a distance D2 between the two locations where the hanging bars 106 and 108 are respectively connected pivotally with the child support frame 104. When the child care apparatus 100 is configured as shown in FIG. 11, the child support frame 104 can remain in a same horizontal orientation during the swing motion.

Figure 12:
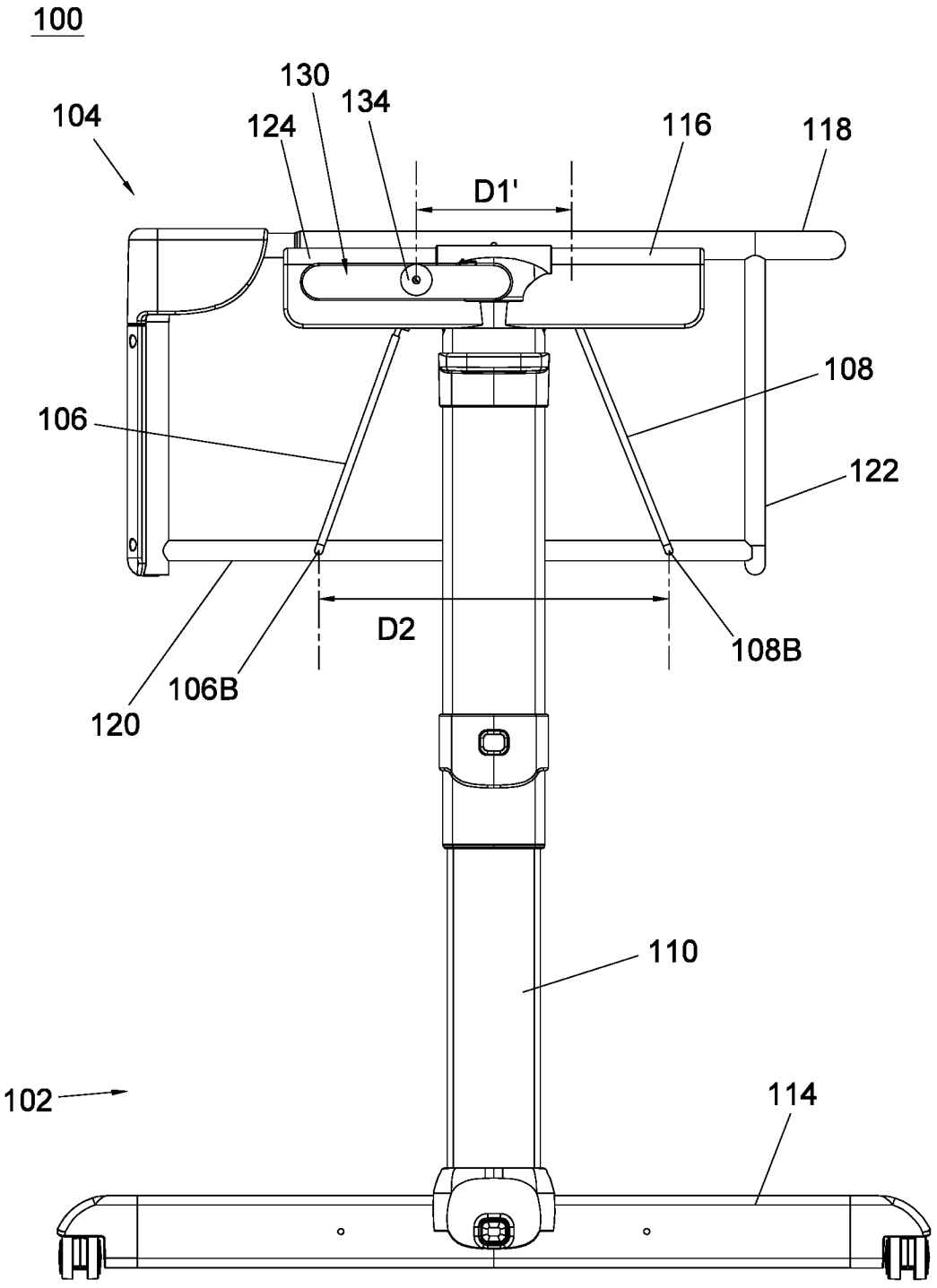
FIG. 12 is a side view illustrating the child care apparatus in another configuration with the upper end portions of the two hanging bars displaced toward each other on the mounting portion.
Figure 13:
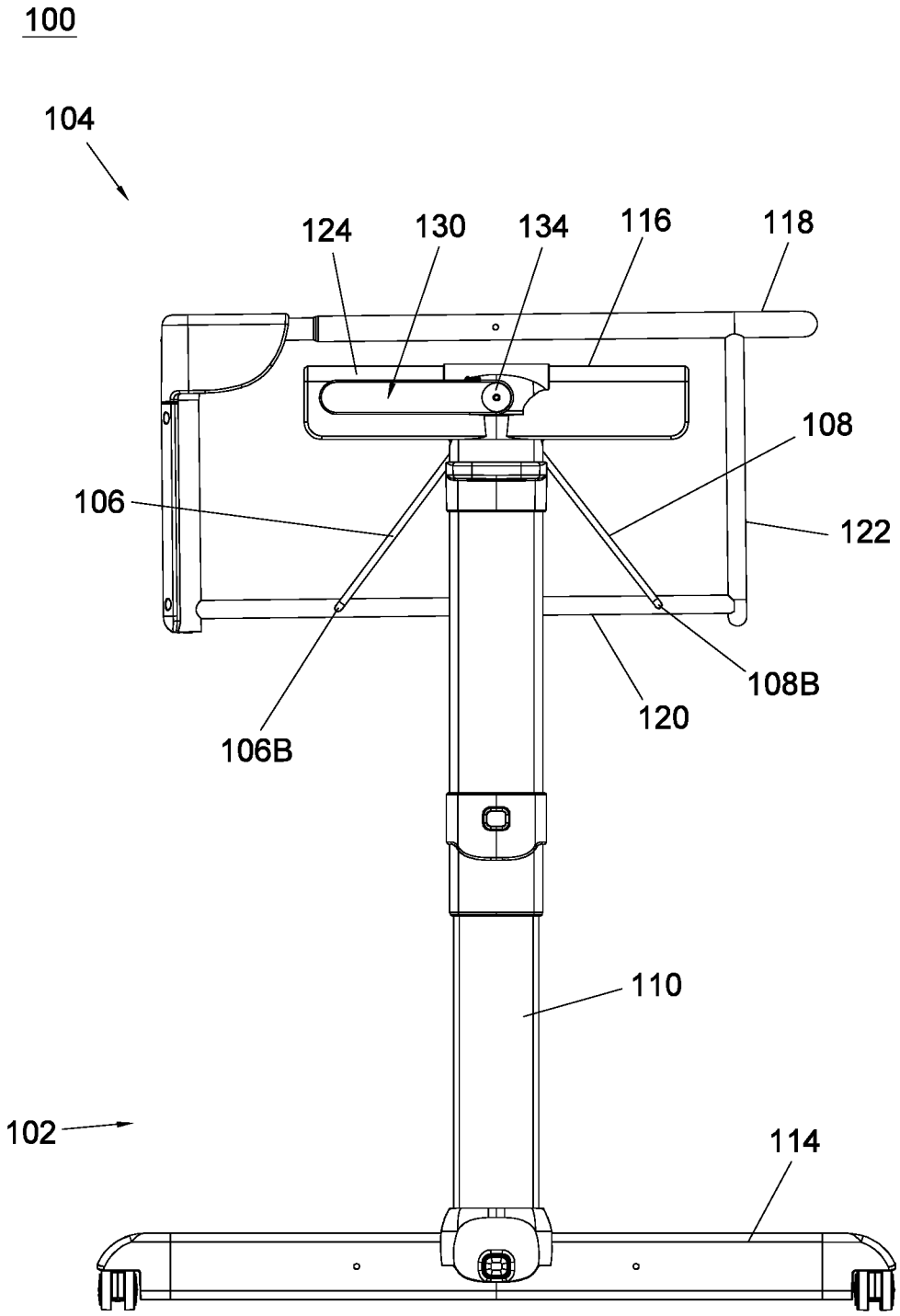
FIG. 13 is a side view illustrating the child care apparatus in yet another configuration with the upper end portions of the two hanging bars fixedly attached to each other on the mounting portion.
Figure 14:
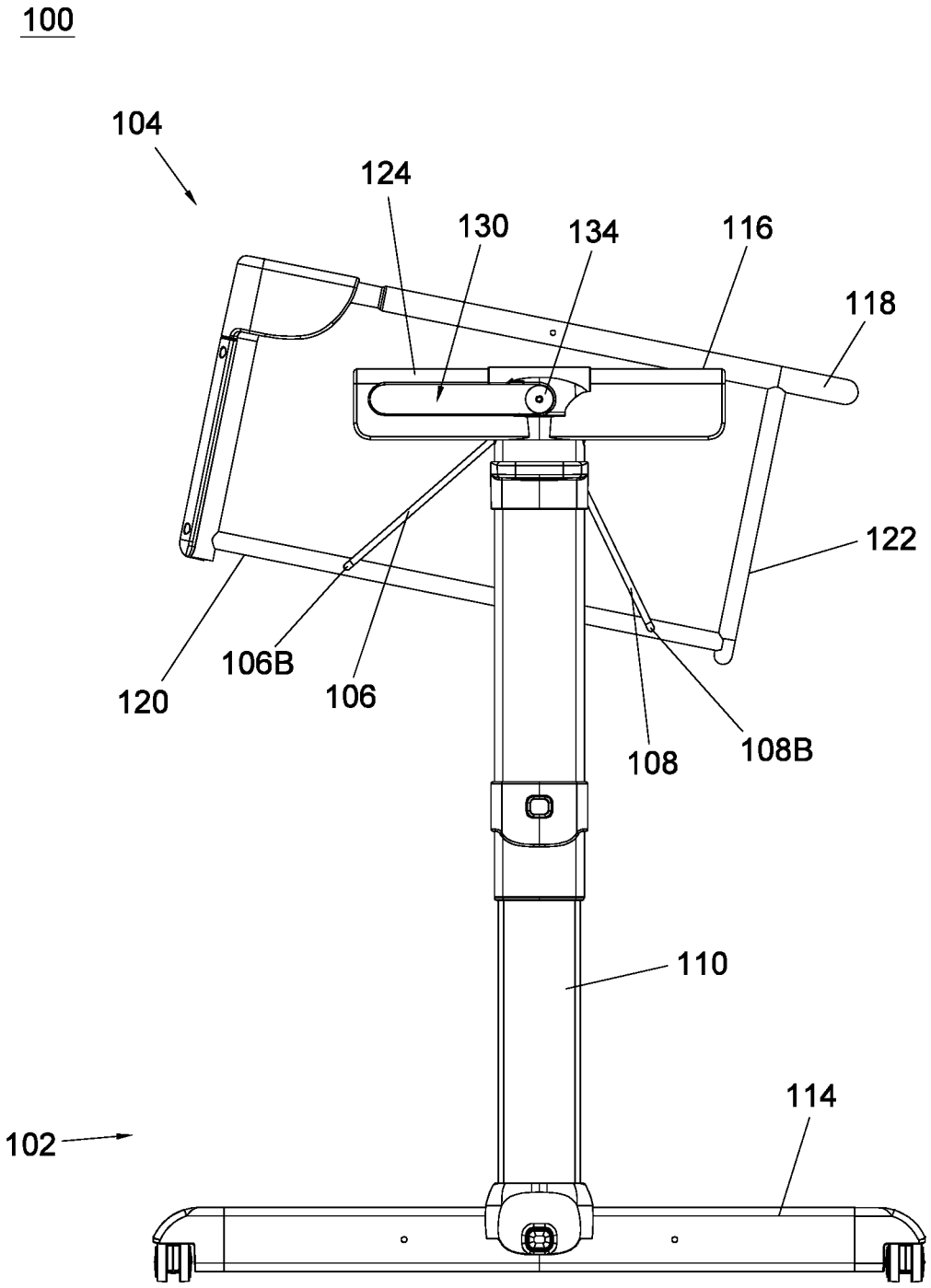
FIG. 14 is a side view illustrating the child care apparatus in the configuration shown in FIG. 13 with the child support frame thereof swung to one side.
Figure 15:
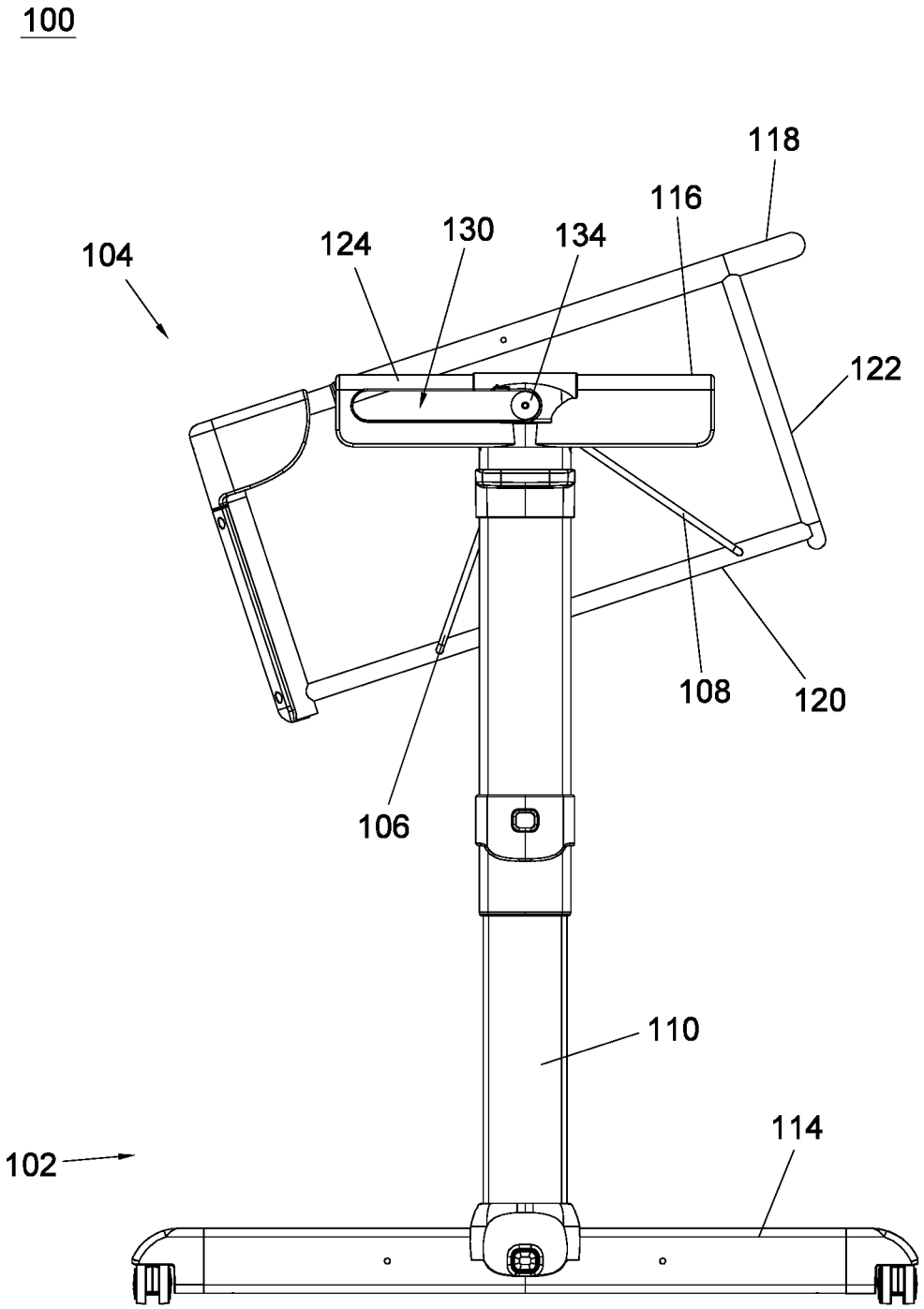
FIG. 15 is a side view illustrating child care apparatus in the configuration shown in FIG. 13 with the child support frame swung to another side.

Referring to FIG. 12, the child care apparatus 100 is shown in another configuration where the end portions 106A and 108A of the hanging bars 106 and 108 are respectively displaced toward each other. In the configuration shown in FIG. 12, the distance D1' between the two positions where the end portion 106A of the hanging bar 106 and the end portion 108A of the hanging bar 108 are respectively supported pivotally by the mounting portion 116 can be smaller than the distance D1 in the configuration shown in FIG. 11, and smaller than the distance D2 between the two locations where the hanging bars 106 and 108 are respectively connected pivotally with the child support frame 104. When the child care apparatus 100 is configured as shown in FIG. 12, the child support frame 104 may be subjected to a limited swing motion relative to the standing frame 102. Moreover, the child support frame 104 may protrude higher above the mounting portion 116 as the end portion 106A of the hanging bar 106 and the end portion 108A of the hanging bar 108 are positioned closer to each other on the mounting portion 116.

Referring to 13-15, the child care apparatus 100 is shown in another configuration where the end portions 106A and 108A of the hanging bars 106 and 108 are fixedly attached to each other with the coupling part 134. The coupling part 134 with the end portions 106A and 108A of the hanging bars 106 and 108 attached thereto may be restrictedly positioned adjacent to a recess 150 (better shown in FIG. 6) provided in the mounting portion 116 between the two receiving slots 130 and 132. The coupling part 134 can thereby pivotally couple the hanging bars 106 and 108 to the mounting portion 116. In the configuration shown in FIGS. 13-15, the hanging bars 106 and 108 and the coupling part 134 can rotate in unison relative to the mounting portion 116 about a same pivot axis for swinging the child support frame 104, and the inclination of the child support frame 104 may change as it is swung back and forth. This provides a swing mode that differs from that provided by the configurations shown in FIGS. 11 and 12.

Advantages of the child care apparatus described herein include the ability to provide a mounting portion on a standing frame that can pivotally support hanging bars at adjustable positions, whereby a child support frame held with the hanging bars can be used in different configurations and can have different swinging modes. Accordingly, the child care apparatus can offer more flexibility and can be more convenient in use.

Realization of the child care apparatus has been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. A child care apparatus comprising:

a standing frame including a mounting portion; and a child support frame held on the standing frame via at least a first and a second hanging bar, the first hanging bar having a first end portion pivotally connected with the mounting portion and the second hanging bar having a second end portion pivotally connected with the mounting portion, the first hanging bar and the second hanging bar being rotatable for swinging the child support frame;

wherein each of the first end portion of the first hanging bar and the second end portion of the second hanging bar is pivotally connected with the mounting portion at a position that is adjustable on the mounting portion, the first end portion of the first hanging bar being fixedly attachable to the second end portion of the second hanging bar with a coupling part that includes a housing and a cover, the housing being fixedly attached to the first hanging bar and having an inner cavity adapted to receive the second end portion of the second hanging bar, and the cover being operable to close over the inner cavity and to open for access to the inner cavity, the coupling part being adapted to pivotally couple the first hanging bar and the second hanging bar to the mounting portion.

2. The child care apparatus according to claim 1, wherein the position of the first end portion of the first hanging bar on the mounting portion is horizontally adjustable.

3. The child care apparatus according to claim 1, wherein the first hanging bar is pivotally connected with the child support frame.

4. The child care apparatus according to claim 1, wherein the first end portion of the first hanging bar is pivotally and slidably connected with the mounting portion.

5. The child care apparatus according to claim 1, wherein the mounting portion has a receiving slot, and the first end portion of the first hanging bar is at least partially disposed in the receiving slot, the first end portion being rotatable in the receiving slot and adjustable to different positions along the receiving slot.

6. The child care apparatus according to claim 5, wherein the receiving slot generally extends along a horizontal axis.

7. The child care apparatus according to claim 1, wherein a distance between two positions where the first end portion of the first hanging bar and the second end portion of the second hanging bar are respectively supported pivotally by the mounting portion is modifiable.

8. The child care apparatus according to claim 1, wherein the mounting portion includes a first and a second receiving slot, the first end portion of the first hanging bar is pivotally supported in the first receiving slot and is adjustable to different positions along the first receiving slot, and the second end portion of the second hanging bar is pivotally supported in the second receiving slot and is adjustable to different positions along the second receiving slot.

9. The child care apparatus according to claim 8, wherein the first and second receiving slot generally extend along a horizontal axis.

10. The child care apparatus according to claim 1, having a configuration where the first end portion of the first hanging bar is fixedly attached to the second end portion of the second hanging bar with the coupling part, and the coupling part is at least partially disposed in the mounting portion, whereby the coupling part, the first hanging bar and the second hanging bar are rotatable in unison relative to the mounting portion about a same pivot axis for swinging the child support frame.

11. The child care apparatus according to claim 1, wherein the coupling part is provided on the first end portion of the first hanging bar, and the child care apparatus has a configuration where the first end portion of the first hanging bar and the coupling part provided thereon are disposed apart from the second end portion of the second hanging bar on the mounting portion.

12. The child care apparatus according to claim 1, wherein the child support frame includes an upper frame portion, a lower frame portion, and a plurality of upright posts connected with the upper and lower frame portions, and the first hanging bar is pivotally connected with the lower frame portion of the child support frame.

13. The child care apparatus according to claim 1, being implemented as a baby crib.

* * * * *